US005968290A

United States Patent [19]

Sakurada et al.

[11] Patent Number: 5,968,290

[45] Date of Patent: Oct. 19, 1999

[54] PERMANENT MAGNET MATERIAL AND BONDED MAGNET

[75] Inventors: Shinya Sakurada, Tokyo; Tomohisa Arai; Keisuke Hashimoto, both of Yokohama; Takahiro Hirai, Kamakura, all of Japan

[73] Assignee: Kabushiki Kaisha Toshiba, Kawasaki, Japan

[21] Appl. No.: 09/048,853

[22] Filed: Mar. 27, 1998

[30] Foreign Application Priority Data

Apr. 3, 1997 [JP] Japan ..... 9-085241
Apr. 15, 1997 [JP] Japan ..... 9-097237

[51] Int. Cl.[6] ..... H01F 1/057

[52] U.S. Cl. ..... 148/302; 148/301; 252/62.54; 428/606

[58] Field of Search ..... 148/301, 302; 252/62.54; 428/606, 607

[56] References Cited

U.S. PATENT DOCUMENTS 5,480,495 1/1996 Sakurada et al. ..... 148/301
5,482,573 1/1996 Sakurada et al. ..... 148/301
5,549,766 8/1996 Tsutai et al. ..... 148/301
5,716,462 2/1998 Sakurada et al. ..... 148/302
5,750,044 5/1998 Yoneyama et al. ..... 252/62.54

FOREIGN PATENT DOCUMENTS 2-57663 2/1990 Japan .
5-82041 11/1993 Japan .

*Primary Examiner*—John Sheehan
*Attorney, Agent, or Firm*—Oblon, Spivak, McClelland, Maier & Neustadt, P.C.

[57] ABSTRACT

A permanent magnet material has a principal phase of TbCu7 type crystal structure and improved magnetic properties. This permanent magnet material is represented by the general formula: $R1_xR2_yB_zN_uM_{100-x-y-z-u}$, wherein R1 is at least one rare earth element including Y, R2 is at least one element selected from the group consisting of Zr, Hf and Sc, M is at least one element selected from Fe and Co, x, y, z and u are atomic percents individually defined as $x \geqq 2$, $y \geqq 0.01$, $4 \leqq x+y \leqq 20$, $0 \leqq z \leqq 10$, and $0 < u \leqq 20$. The permanent magnet material has a principal phase of a $TbCu_7$ type crystal structure. The permanent magnet material satisfies the relation of $t \leqq 60$ and $\sigma/t \leqq 0.7$, wherein t(nm) is an average crystal grain size of the principal phase and $\sigma$(nm) is a standard deviation of the crystal grain size.

22 Claims, No Drawings

PERMANENT MAGNET MATERIAL AND BONDED MAGNET

BACKGROUND OF THE INVENTION

The invention relates to a permanent magnet material and a bonded magnet.

Hitherto, as a type of high-property permanent magnets of rare earth elements, Sm—Co magnets and Nd—Fe—B magnets and the like have been known. These high-property magnets are used in electric appliances such as a speaker, a motor and a measuring tool. As the demand for miniaturizing various electric appliances is elevated in recent years, the demand for developing a higher property permanent magnet is raised.

In compliance with such a demand, the inventors suggested a $TbCu_7$ type compound and a nitride thereof which have a high saturation magnetization and excellent magnetic properties in Jpn. Pat. Appln. KOKAI Publication No. 6-172936 and Jpn. Pat. Appln. KOKAI Publication No. 9-74006.

The magnet material having the $TbCu_7$ type crystal structure as a principal phase is generally produced via a rapid quenching process such as a melt spun process and a mechanical alloying process. However, magnetic properties of resulting magnet material are often changed by a condition of the above-mentioned process, so as to make it difficult to produce a high property magnet material stably.

BRIEF SUMMARY OF THE INVENTION

An object of the present invention is to provide a permanent magnet material having a $TbCu_7$ type crystal structure as the principal phase and improved magnetic properties.

Another object of the invention is to provide a bonded magnet which contains the above-mentioned permanent magnet material and a binder and has high and stable, magnetic properties.

According to the present invention, there is provided a permanent magnet material made from a raw material comprising a rapid-quenched alloy ribbon which is prepared through a melt spun process, satisfying the relation of $5 \leqq t \leqq 50$ and $\sigma \leqq 0.20t$, wherein t(μm) is an average thickness of the alloy ribbon and σ(μm) is a standard deviation of the thickness in the alloy ribbon, which has a principal phase of a $TbCU_7$ type crystal structure, the permanent magnet material represented by the general formula:

$$R1_xR2_yB_zN_uM_{100-x-y-z-u}$$

wherein R1 is at least one rare earth element including Y, R2 is at least one element selected from the group consisting of Zr, Hf and Sc, M is at least one element selected from Fe and Co, x, y, z and u are atomic percents individually defined as $x \geqq 2$, $y \geqq 0.01$, $4 \leqq x+y \leqq 20$, $0 \leqq z \leqq 10$, and $0<u \leqq 20$.

According to the present invention, there is provided a bonded magnet comprising the above-mentioned permanent magnet material and a binder.

According to the present invention, there is provided a permanent magnet material, represented by the general formula:

$R1_xR2_yB_zN_uM_{100-x-y-z-u}$ wherein R1 is at least one rare earth element including Y, R2 is at least one element selected from the group consisting of Zr, Hf and Sc, M is at least one element selected from Fe and Co, x, y, z and u are atomic percents individually defined as $x \geqq 2$, $y \geqq 0.01$, $4 \leqq x+y \leqq 20$, $0 \leqq z \leqq 10$, and $0<u \leqq 20$, having a principal phase of a $TbCu_7$ type crystal structure, and satisfying the relation of $t \leqq 60$ and $\sigma/t \leqq 0.7$, wherein t(nm) is an average crystal grain size of the principal phase and σ(nm) is a standard deviation of the crystal grain size.

According to the present invention, there is provided a bonded magnet comprising the above-mentioned permanent magnet material and a binder.

DETAILED DESCRIPTION OF THE INVENTION

The present invention will be described in detail in the following.

The raw material of the permanent magnet material of the invention is a rapid-quenched alloy ribbon prepared through the melt spun process. The alloy ribbon has a $TbCu_7$ type crystal structure as a principal phase. The alloy ribbon satisfies the relation of $5 \leqq t \leqq 50$, $\sigma \leqq 0.20t$, wherein t(μm) represents an average thickness and σ(μm) represents a standard deviation of the thickness. The composition of the permanent magnet material is represented by the general formula $R1_xR2_yB_zN_uM_{100-x-y-z-u}$, wherein R1 is at least one rare earth element (including Y); R2 is at least one element selected from Zr, Hf and Sc, M is at least one element from Fe and Co; and x, y, z and u are atomic percents individually defined as $x \geqq 2$, $y \geqq 0.01$, $4 \leqq x+y \leqq 20$, $0 \leqq z \leqq 10$, $0<u \leqq 20$.

The principle phase of the alloy ribbon is a phase occupying the maximum proportion of the alloy ribbon. The principal phase having the $TbCu_7$ type crystal structure takes charge of magnetic properties. It is preferred that the principal phase occupies 50 or more percentages by volume of the permanent magnet material because decrease in the principal phase content percentage does not cause reflection of the property of the principal phase.

The alloy ribbon has the $TbCu_7$ type crystal structure as the principal phase. When the ratio of the lattice constants a and c of the $TbCu_7$ phase, i.e., c/a ratio is 0.847 or more, it becomes possible to heighten saturation magnetization and residual magnetization. The c/a ratio can be controlled by the proportion of the components constituting the permanent magnet material, and the process for producing the material.

If the average thickness (t) of the alloy ribbon is less than 5 μm, it is easy to precipitate α-Fe in the principal phase in the permanent magnet material. Also, it is probably difficult to control the thickness per se of the alloy ribbon. On the other hand, if the average thickness of the alloy ribbon exceeds 50 μm, it becomes difficult that the permanent magnet material obtained from the alloy ribbon has a high residual magnetization. A more preferable range of t(μm) is $10 \leqq t \leqq 25$.

If the standard deviation (σ) of the thickness of the alloy ribbon exceeds 0.20t, the magnetic properties are remarkably deteriorated. A more preferable of σ(μm) is 0.15t or less, and the most preferable σ(μm) is 0.10t or less.

The permanent magnet material of the invention can be obtained not only from a single rapid-quenched alloy ribbon but also from two or more raw materials of rapid-quenched alloy ribbons having different standard deviations of their thickness. In the case, the two or more raw materials of the alloy ribbons need to satisfy the above-mentioned conditions about the average thickness t(μm) and the standard deviation σ(μm) of the thickness, respectively.

The following will describe the function of the elements constituting the permanent magnet material represented by the general formula and the reason for specifying the respective element contents.

(1) R1 Element

Rare earth elements for the R1 element include La, Ce, Pr, Nd, Sm, Eu, Gd, Tb, Dy, Ho, Er, Tm, Lu and Y. One or more of these elements may be used. The R1 element provides a large magnetocrystalline anisotropy and a high coercive force to the permanent magnet material. Especially, it is preferred that 50 or more atomic percentages of the R1 element are occupied by Sm and the remaining portion is occupied by at least one element selected from Pr, Nd and Ce.

If the R1 element is 2 or less atomic percentages, the magnetocrystalline anisotropy greatly decreases, so as to make it difficult to obtain a permanent magnet material having a large coercive force. If the R1 is incorporated in an excess amount, it is afraid that the magnetization of the permanent magnet material is reduced. Therefore, the range of the R1 element content x is preferably $4 \leqq x \leqq 16$, and more preferably $6 \leqq x \leqq 12$.

(2) R2 Element

The R2 element may be at least one element selected from the group consisting of Zr, Hf and Sc. The R2 element makes it possible to elevate the Fe and Co contents in the $TbCu_7$ phase, which is the principal phase, by mainly occupying the sites of the rare earth elements in the principal phase and decreasing the average atomic radius of the rare earth sites. These elements also have the function of making the crystal grains of the $TbCu_7$ phase minute. These elements are useful to improve coercive force and residual magnetization. The range of the amount (y) in the R2 element content is preferably $0.1 \leqq y$, and more preferably $1 \leqq y \leqq 3$.

If the total proportion of the R1 and R2 elements is less than 4 atomic percentages, the precipitation of α-Fe(Co) increases very much, so as to make it difficult to obtain a permanent magnet material having a large coercive force. On the other hand, if the total proportion of the R1 and R2 elements exceeds 20 atomic percentages, the magnetization of the permanent magnet material decreases. The range of the total proportions (x+y) of the R1 and R2 elements is more preferably $4 \leqq x+y \leqq 16$.

(3) B(boron)

Boron is a helpful element for improving residual magnetic flux density but is not essential to the magnet material. If the boron content exceeds 10 atomic percentages, it is afraid that the production of an $R_2Fe_{14}B$ phase increases in a heat-treating process so as to deteriorate magnetic properties of the permanent magnet material.

When the magnet material contains boron, the range of the amount (z) thereof is preferably $0.01 \leqq z \leqq 4$, and more preferably $1 \leqq z \leqq 3$.

(4) Nitrogen

Nitrogen may be present mainly at interstitial sites in the principal phase. Nitrogen has the function of making magnetic anisotropy and the curie temperature of the principal phase higher than the case of containing no nitrogen. Especially, the improvement in the magnetic anisotropy is important for providing a large coercive force to the permanent magnet material.

Nitrogen can exhibit its effect in a small amount. When the proportion of nitrogen exceeds 20 atomic %, the precipitation of α-Fe(Co) increases. The range of the amount (u) in nitrogen is preferably $2 \leqq u \leqq 20$ and more preferably $10 \leqq u \leqq 20$.

Magnetic properties such as coercive force can be improved by replacing 50 or less atomic percentages of nitrogen by at least one element selected from the group of H, C and P.

(5) M Element

The M element is at least one element selected from Fe and Co, and has the function of increasing saturation magnetization of the permanent magnet material. Residual magnetization increases with the increase in the saturation magnetization, so as to heighten a maximum energy product accordingly. The saturation magnetization is efficiently increased by incorporating the M element into the permanent magnet material in a proportion of 70 or more atomic %. For making the saturation magnetization far higher, it is preferable that 50 or more percentages of the total amount of any M elements are occupied by Fe.

It is preferable that the M content in the principal phase is 90 or more atomic %. Increase in the M element concentration in the principal phase causes enlargement in saturation magnetization of the permanent magnet material, thereby improving magnetic properties thereof still more. Especially, when the M element concentration in the principal phase is 90 or more atomic %, the above-mentioned effect is remarkably exhibited.

It is allowable to replace 20 or less atomic % of the M element by at least one element (T element) selected from Ti, V, Cr, Mo, W, Mn, Ga, Al, Sn, Ta, Nb, Si and Ni. This replacement by the T element enables improvement in practically important properties such as corrosion resistance, heat-resistance and coercive force. However, if 20 or more atomic percentages of the M element are replaced by the T element, magnetic properties deteriorate considerably.

The permanent magnet material according to the invention may contain inevitable impurities such as an oxide.

The following will explain the method for producing the permanent magnet material of the invention in detail.

Firstly, an ingot containing respective elements in predetermined amounts and an optional T element for replacing a part of the M element is prepared by arc melting or induction melting. This ingot is cut into small pieces, and melted by any method such as induction heating. Subsequently, the melted metal is subjected to the melt spun process. Namely, the melted metal is sprayed from a nozzle onto a metallic roller which is being rotated at a high speed, so as to obtain a rapid-quenched alloy ribbon. In this step, the thickness of the alloy ribbon can be controlled by controlling the hole diameter of the nozzle, the rolling speed of the roller, a pressure for spray and the like.

For the melt spun process, there may be used a single roller, twin rollers, and the like manners.

The melt spun process is preferably carried out in the atmosphere of inert gas, such as Ar or He. By rapid-quenching in such an atmosphere, deterioration of magnetic properties resulted from the oxidation can be prevented.

The alloy ribbon obtained by the melt spun process may be optionally subjected to heat-treatment in the atmosphere such as Ar or He or in a vacuum at 300 to 1000° C. for 0.1 to 10 hours. The heat-treatment makes it possible to improve magnetic properties such as coercive force.

In the next step, if necessary, the alloy ribbon is pulverized into particles having an average particle size from several μm to several hundred μm with a ball mill, a brown mill, a stamp mill, a jet mill or the like. The pulverized alloy is subjected to heat-treatment (nitriding treatment) in the atmosphere of nitrogen gas to produce a permanent magnet material.

The nitriding treatment is preferably carried out at a temperature from 300 to 500° C. and at a pressure from 0.001 to 100 atoms in the atmosphere of nitrogen gas. The nitriding treatment at such temperature and pressure may be conducted for 0.1 to 300 hours.

As the atmosphere for the nitriding treatment, a nitrogen-containing compound gas, such as ammonia gas, may be used instead of nitrogen. The use of ammonia gas enables to heighten a nitriding reaction speed. If gas such as hydrogen gas, argon gas or nitrogen gas is used together with ammonia, the nitriding reaction speed can be controlled.

As a pre-treatment of the nitriding treatment, heat-treatment is conducted at a temperature from 100 to 700° C., and at a pressure from 0.001 to 100 atoms in the atmosphere of hydrogen gas, or alternatively, gas in which hydrogen is mixed with nitrogen gas is used, so as to make highly efficient nitriding possible.

In the above-mentioned method for producing a permanent magnet material, there may be used a method of adjusting conditions such as a melt temperature, a roller rotating speed, a roller surface state, a nozzle hole form, a nozzle hole size, a gap between the nozzle and the roller and the like in order to control variation in thickness of the alloy ribbon. For example, in the case of making the area of the nozzle hole larger so that the amount of spraying, melted alloy per unit time will increase, a suitable control, for example, a rise in the roller rotating speed, should be conducted accordingly.

The permanent magnet material described above is made from a raw material composed of a rapid-quenched alloy ribbon which is prepared through the melt spun process. The alloy ribbon satisfies the relation of $5 \leqq t \leqq 50$ and $\sigma \leqq 0.20t$, wherein t($\mu$m) is an average thickness of the alloy ribbon and $\sigma$($\mu$m) is a standard deviation of the thickness in the alloy ribbon. The alloy ribbon has a principal phase of a $TbCu_7$ crystal structure. The permanent magnet material is represented by the general formula $R1_xR2_yB_zN_uM_{100-x-y-u}$. The raw material composed of such an alloy ribbon wherein the variation of its thickness is controlled as above is, for example, pulverized and heat-treated in the atmosphere containing nitrogen so as to give a permanent magnet material having good and stable magnetic properties.

In short, there is a remarkable correlation between the variation in the thickness of the rapid-quenched alloy ribbon obtained by the melt spun process and the property of the magnet material made from the alloy ribbon. This is considered to be caused by the matter that the thickness of the alloy ribbon represents its microstructure, especially its crystal grain size. In other words, considering that the optimal condition of post-treatment for the alloy ribbon, in particular heat-treatment in the atmosphere of nitrogen gas for introducing nitrogen into the alloy, is different dependently on the particular microstructure and crystal grain size, the variation in the microstructure or the thickness of the alloy ribbon would permit the appearance of both the portion wherein an appropriately nitriding treatment is conducted and that wherein an inappropriately nitriding treatment is conducted, so that high magnetic properties of the whole magnet material could not be obtained when the microstructure or the thickness of the alloy ribbon has variation.

From the above-mentioned viewpoint, reducing variation in the thickness of the rapid-quenched alloy ribbon, as accomplished by the invention, makes it possible to bring out high magnetic properties originated from the composition of the magnet material, if only the condition of the post-treatment is appropriate. Therefore, a permanent magnet material can be obtained which has good and stable magnetic properties.

The bonded magnet according to the invention will be described below.

The bonded magnet can be obtained by mixing the powder of the permanent magnet material and a binder and then compression-molding or injection-molding it.

The binder may be a synthetic resin such as an epoxy resin or nylon. When a thermal-setting resin such as an epoxy resin is used as the synthetic resin, it is preferred that the resin is compression-molded and subsequently is subjected to cure-treatment at a temperature from 100 to 200° C. When a thermoplastic resin such as a nylon is used as the synthetic resin, it is desired to use an injection-molding.

If in the compression-mounding step crystalline directions of the alloy powder are made uniform by applying a magnetic field to the powder, a bonded magnet having a high magnetic flux density can be obtained.

A low melting point metal or alloy may be used as the binder to produce a metal bonded magnet. The low melting point metal includes Al, Pb, Sn, Zn, Cu, and Mg. The low melting point alloy may be an alloy containing any one of these metal.

This bonded magnet according to the invention contains the above-mentioned permanent magnet material having high magnetic properties the variation of which is very low, so as to exhibit high and stable magnetic properties.

The following will describe another permanent magnet material of the invention.

This permanent magnet material is represented by the general formula: $R1_xR2_yB_zN_uM_{100-x-y-z-u}$, wherein R1 is at least one rare earth element including Y, R2 is at least one element selected from the group consisting of Zr, Hf and Sc, M is at least one element selected from Fe and Co, x, y, z and u are atomic percents individually defined as $x \geqq 2$, $y \geqq 0.01$, $4 \leqq x+y \leqq 20$, $0 \leqq z \leqq 10$, and $0 < u \leqq 2$. Its principal phase has a $TbCu_7$ type crystal structure. The permanent magnet material satisfies the relation of $t \leqq 60$ and $\sigma/t \leqq 0.7$, wherein t(nm) is an average crystal grain size of the principal phase and $\sigma$(nm) is a standard deviation of the crystal grain size.

The principle phase is a phase occupying the maximum proportion of the permanent magnet material. The principal phase having the $TbCu_7$ type crystal structure takes charge of magnetic properties. It is preferred that the principal phase occupies 50 or more percentages by volume of the permanent magnet material because decrease in the principal phase content percentage does not cause reflection of the property of the principal phase.

The function of the elements constituting the permanent magnet material represented by the general formula and the reason for specifying the respective element contents are the same as in the items (1)–(5) about the first permanent magnet material. It is allowable to replace 20 or less atomic % of the M element by at least one element (T element) selected from Ti, V, Cr, Mo, W, Mn, Ga, Al, Sn, Ta, Nb, Si and Ni. This replacement by the T element enables improvement in practically important properties such as corrosion resistance, heat-resistance and coercive force. However, if 20 or more atomic percentages of the M element are replaced by the T element, magnetic properties deteriorate considerably.

The permanent magnet material according to the invention may contain inevitable impurities such as an oxide.

The permanent magnet material according to the invention has the $TbCu_7$ type crystal structure as the principal phase. When the ratio of the lattice constants a and c of the $TbCu_7$ phase, i.e., the ratio c/a is 0.847 or more, it is to heighten saturation magnetization and residual magnetization. The ratio c/a can be controlled by the proportion of the components constituting the permanent magnet material and the process for producing the material.

The following will give an explanation of an example of methods for measuring the average crystal grain size t(nm) of the principal phase and the standard deviation $\sigma$(nm) of the crystal grain size.

In the case of taking a photo of the metallic texture of a permanent magnet material by means of a transmission electron microscope, and observing the crystal grains of a $TbCu_7$ phase based on the photo, the crystal grain size $r_n$(nm) is defined by the following equation (1):

$$r_n = 2\times(\sqrt{Sn})/\pi \quad (1)$$

wherein Sn is a section area ($nm^3$).

The average crystal grain size t(nm) is the average value of the respective crystal grain sizes $r_n$, and is defined by the following equation (2):

$$t=(1/N)\times\Sigma r_n \quad (2)$$

wherein N is the number of measured crystal grains.

On the contrary, the standard deviation σ(nm)of the crystal grain size is defined by the following equation (3):

$$\sigma = \sqrt{\{[N\sum r_n^2 - (\sum r_n)^2]/N\}} \quad (3)$$

When t and σ are measured by this method, the number N is preferably 60 or more.

If the average crystal grain size t of the principal phase exceeds 60 nm, it is difficult to obtain a magnet material having a large residual magnetization. The preferably range of t is t≦30 nm.

If the ratio of the standard deviation σ of the crystal grain size to the average crystal grain size t (i.e. σ/t) exceeds 0.7, the magnetic property deteriorates considerably. The σ/t is preferably 0.5 or less, and more preferably 0.3 or less.

The permanent magnet material according to this embodiment may be produced in the same manner as for the aforementioned first embodiment. For controlling variation in the crystal grain size in production of this permanent magnet material, there may be adopted a method for controlling the process condition of the rapid-quenching step to make the crystal grain size uniform during the rapid-quenching, or for designing the heat-treatment condition in the heat-treatment step to make the crystal grain size uniform. For the purpose of making the crystal grain size uniform in the rapid-quenching step, it is useful to control conditions, such as an injection pressure, a roller rotating speed, a roller surface state, and a form or size of a nozzle hole, so as to make the thickness of the alloy ribbon uniform. For example, in the case of making the injection pressure high and making the area of the nozzle hole large so that the amount of spraying, melted alloy per unit time will increase, the roller rotating speed should be raised accordingly. However, when the roller rotating speed be raised excessively, it is afraid that the thickness of the obtained alloy ribbon is too thin to keep the uniformity of the thickness thereof.

Uniformizing the thickness of the rapid-quenched alloy ribbon as above makes it possible to uniformize the crystal grain sizes of the principle phases generated in the respective portions of the alloy ribbon.

Specifically, when the average crystal grain size, the standard deviation of the crystal grain size, the standard deviation of the thickness of the rapid-quenched alloy ribbon, and the thickness of the alloy ribbon are represented by t(nm), σ(nm), $\sigma_r$(μm), $t_r$(μm), respectively, $\sigma_r/t_r$ is preferably 0.1 or less for the purpose of setting the σ/t to 0.7 or less.

Another permanent magnet material according to the invention, as described just above, is represented by the general formula $R1_xR2_yB_zN_uM_{100-x-y-u}$, has a principal phase of a $TbCu_7$ type crystal structure, and satisfies the relation of t≦60 and σ/t≦0.7, wherein t(nm) is an average crystal grain size of the principal phase and σ(nm) is a standard deviation of the crystal grain size. By controlling the variation in the crystal grain size in the permanent magnet material having such specified composition and principal phase as above, excellent magnetic properties can be obtained.

As mentioned above, the another permanent magnet material is produced through the step of nitriding treatment. In this step of nitriding treatment, a raw material powder having the same composition as that of the general formula except that no nitrogen is contained is generally heat-treated in the atmosphere containing nitrogen gas or nitrogen-containing compound gas, so that nitrogen can be taken in, i.e., introduced in the powder (the alloy). In this case, it is thought that firstly nitrogen penetrates into crystal grain boundaries and then penetrates (diffuses) into crystal grains. Even if the nitriding treatment is conducted under the condition that nitrogen is sufficiently introduced into the crystal grain having some size, a wide variation in crystal grain sizes gives an area in which nitrogen is not introduced sufficiently into crystal grains having a larger size. On the contrary, it is presumed that in crystal grains having a smaller size, excess nitrogen comes into existence, or α-Fe is precipitated by a disproportion reaction. In a portion which nitrogen is introduced insufficiently or excessively, magnetic anisotropy is decreased. This is a factor which makes the magnetic properties decrease. The precipitation of α-Fe causes a bad influence on coercive force and squareness ratio.

From the above-mentioned viewpoint, if the variation in crystal grain sizes is small and the nitriding condition is made proper as in the invention, nitrogen in a necessary and sufficient amount can be introduced into all the crystal grains. As a result, a permanent magnet material having good magnetic properties can be obtained.

The following will describe another bonded magnet according to the invention.

The bonded magnet can be obtained by mixing the powder of the permanent magnet material and a binder and then compression-molding or injection-molding it.

The binder may be a synthetic resin such as an epoxy resin or nylon. When a thermal-setting resin such as an epoxy resin is used as the synthetic resin, it is preferred that the resin is compression-molded and subsequently is subjected to cure-treatment at a temperature from 100 to 200° C. When a thermoplastic resin such as a nylon is used as the synthetic resin, it is desired to use an injection-molding.

If in the compression-molding step crystalline directions of the alloy powder are made uniform by applying a magnetic field to the powder, a bonded magnet having a high magnetic flux density can be obtained.

A low melting point metal or alloy may be used as the binder to produce a metal bonded magnet. The low melting point metal includes Al, Pb, Sn, Zn, Cu, and Mg. The low melting point alloy may be an alloy containing any one of these metal.

This bonded magnet according to the invention contains the above-mentioned permanent magnet material having high magnetic properties the variation of which is very low, so as to exhibit high and stable magnetic properties.

Preferable examples of the invention will be described in detail below.

EXAMPLES 1–3

Firstly, Sm, Zr, Fe, Co and B having high purity were mixed in predetermined proportions and melted by a high frequency wave in the atmosphere of Ar gas to obtain three kinds of ingots. Subsequently, these ingots were melted in a chamber under the argon gas atmosphere, followed by spraying the melted metals onto a copper roller with a diameter of 300 mm which was rotated at a rotating speed of 30 m/s and at an injection pressure of 15 kPa to produce rapid-quenched alloy ribbons. The phases in these alloy ribbons were observed by a powder X ray diffraction using a $CuK_\alpha$ ray. As a result, all diffraction peaks except the diffraction peak of a minute α-Fe phase on the diffraction pattern were identified to a $TbCu_7$ type crystal structure. The ratio of the lattice constant c to the lattice constant a (c/a) was found to be from 0.856 to 0.868.

The portions along the width direction of the respective alloy ribbons were measured 60 times with a micrometer. From the measurement, the average value of the thickness and the standard deviation of thickness were calculated. The obtained results are shown in Table 1 below.

Next, the respective alloy ribbons were heat-treated in the argon gas atmosphere at 720° C. for 15 minutes and then pulverized in a ball mill to produce alloy powders having an average particle size of 30 μm. These alloy powders were heat-treated (i.e., nitriding treatment) in the nitrogen gas atmosphere at 1 atom and 440° C. for 60 hours to produce three kinds of permanent magnet materials shown in Table 1.

After that, 2 percentages by weight of an epoxy resin were added into the permanent magnet materials and mixed followed by being compression-molded at a pressure of 1000 MPa and cure-treated at 150° C. for 2.5 hours to manufacture three kinds of bonded magnets.

The magnetic properties of the obtained bonded magnets were examined. The resultants are also shown in Table 1.

COMPARATIVE EXAMPLE 1

Firstly, Sm, Zr, Fe, Co and B having high purity were mixed in a predetermined proportion and melted by a high frequency wave in the argon gas atmosphere to obtain an ingot. Subsequently, an alloy ribbon was produced from the ingot in the same manner as in Examples 1–3, except that the injection pressure for the melted metal was 70 kPa, and the rotating speed of the copper roller was 60 m/s. The alloy ribbon was subjected to heat-treatment in the argon gas atmosphere, pulverizing, and heat-treatment in nitrogen gas to produce a permanent magnet material having the composition shown in Table 1, in the same manner as in Examples 1–3. Furthermore, the magnet material was used to produce a bonded magnet in the same manner as in Examples 1–3.

The magnetic properties of the obtained bonded magnet are also shown in Table 1. The portions along the width direction of the alloy ribbon were measured 60 times with a micrometer. From the measurement, the average value of the thickness of the alloy ribbons and the standard deviation of thickness of the alloy ribbons were calculated. The resultants are also shown in Table 1 below.

TABLE 1

| | Composition of the permanent magnet materials (bal.: balance) | Average thickness of rapid-quenched alloy ribbons (μm) | σ/t | Maximum energy product (kJ/m³) |
|---|---|---|---|---|
| Example 1 | $Sm_6Zr_{2.2}Co_{3.8}B_{1.9}N_{24}$Febal. | 16.2 | 0.087 | 87.5 |
| Example 2 | $Sm_{6.3}Zr_{2.2}Co_{3.8}B_{1.9}N_{14}$Febal. | 20.4 | 0.096 | 85.9 |
| Example 3 | $Sm_{6.5}Zr_{2.1}Co_{3.8}B_{1.9}N_{14}$Febal. | 15.9 | 0.123 | 77.9 |
| Comparative Example 1 | $Sm_{6.3}Zr_{2.1}Co_{3.8}B_{1.9}N_{14}$Febal. | 12.4 | 0.210 | 59.6 |

As apparent from Table 1, the bonded magnets according to Examples 1–3, which contain magnet materials obtained from the rapid-quenched alloy ribbons having a small standard deviation of the thickness, i.e., narrow variation in the thickness, are superior to the bonded magnet according to Comparative Example 1 in the magnetic properties, in particular a maximum energy product.

EXAMPLES 4–17

Firstly, Sm, Nd, Pr, Gd, Dy, Zr, Hf, Ti, V, Cr, Mo, W, Mn, Al, Sn, Ta, Nb, Si, Fe, Co, Ni, B, C and P having high purity were prepared. Suitable elements among them were mixed in predetermined proportions and melted by a high frequency wave in the argon gas atmosphere to obtain ingots. Subsequently, these ingots were melted in a chamber under the argon gas atmosphere, followed by spraying the melted metals onto a copper roller with a diameter of 300 mm which was being rotated at a rotating speed of 30–50 m/s and at an injection pressure of 15 kPa to produce fourteen kinds of rapid-quenched alloy ribbons. The phases in these alloy ribbons were observed by a powder X ray diffraction using a $CuK_\alpha$ ray. As a result, all diffraction peaks except the diffraction peak of a minute α-Fe phase on the diffraction pattern were identified to a $TbCu_7$ type crystal structure. The ratio of the lattice constant c to the lattice constant a (c/a) was found to be from 0.856 to 0.868.

Next, the respective alloy ribbons were heat-treated in the argon atmosphere gas at 750° C. for 30 minutes and then pulverized in a ball mill to produce alloy powders having an average particle size of 60 μm. These alloy powders were heat-treated (i.e., nitriding treatment) in the nitrogen gas atmosphere at 5 atom and 440° C. for 40 hours to produce fourteen kinds of permanent magnet materials shown in Table 2.

After that, two percentages by weight of an epoxy resin were added into the permanent magnet materials and mixed followed by being compression-molded at a pressure of 1000 MPa and cure-treated at 150° C. for 2.5 hours, to manufacture fourteen kinds of bonded magnets.

The magnetic properties of the obtained bonded magnets were examined. The resultants are shown in Table 3. The portions along the width direction of the alloy ribbons were measured 60 times with a micrometer. From the measurement, the average value of the thickness and the standard deviation of thickness were calculated. The obtained results are also shown in Table 3 below.

TABLE 2

| | Composition of permanent magnet materials (bal.: balance) |
|---|---|
| Example 4 | $Sm_{6.7}Zr_{2.2}Co_{3.4}Ni_{1.3}B_{1.7}N_{14}Fe$ bal. |
| Example 5 | $Sm_{6.3}Zr_{2.3}Co_4B_2P_{0.5}N_{14}Fe$ bal. |
| Example 6 | $Sm_{6.4}Zr_2Co_{3.8}B_{1.3}C_{0.4}N_{15}Fe$ bal. |
| Example 7 | $Sm_{6.7}Zr_{2.1}Co_{3.7}C_{1.3}P_{0.4}N_{16}Fe$ bal. |
| Example 8 | $Sm_{6.6}Zr_{2.2}Co_{4.5}Nb_{0.4}Ti_{0.5}B_{1.8}N_{12}Fe$ bal. |
| Example 9 | $Sm_{6.5}Zr_{2.2}Co_{7.7}Gal_1Al_{0.2}B_2N_{14}Fe$ bal. |
| Example 10 | $Sm_{6.5}Zr_{2.2}Co_{3.9}Cr_{0.8}V_{0.4}Mo_{0.4}B_{1.7}N_{14}Fe$ bal. |
| Example 11 | $Sm_{7.1}Zr_{1.3}Co_{3.8}Mon_{0.4}B_{1.7}N_{15}Fe$ bal. |
| Example 12 | $Sm_{6.5}Zr_{2.2}Co_{4.5}Ta_{0.1}W_{0.2}Sn_{0.2}Si_{0.4}B_{1.5}N_{13}Fe$ bal. |
| Example 13 | $Sm_{6.5}Zr_{2.2}Hf_{0.4}Co_4B_{1.7}N_{14}Fe$ bal. |
| Example 14 | $Sm_{6.8}Nd_{0.9}Zr_{1.8}Co_{4.1}B_2N_{10}Fe$ bal. |
| Example 15 | $Sm_{5.8}Nd_{0.9}Dy_{0.4}Zr_{1.8}Co_4N_{11}Fe$ bal. |
| Example 16 | $Sm_{6.1}Pr_{0.4}Zr_{1.7}Co_{3.9}B_{1.7}N_{13}Fe$ bal. |
| Example 17 | $Sm_{6.8}Nd_{0.4}Gd_{0.1}Zr_{1.8}Co_{4.1}B_{1.8}N_{10}Fe$ bal. |

TABLE 3

| Example | Average thickness of rapid-quenched alloy ribbons ($\mu$m) | σ/t | Maximum energy product (kJ/m$^3$) |
|---|---|---|---|
| Example 4 | 19.1 | 0.072 | 89.0 |
| Example 5 | 22.1 | 0.076 | 87.5 |
| Example 6 | 17.5 | 0.165 | 71.6 |
| Example 7 | 17.5 | 0.165 | 71.6 |
| Example 8 | 16.0 | 0.095 | 86.7 |
| Example 9 | 16.7 | 0.115 | 75.5 |
| Example 10 | 15.2 | 0.155 | 70.0 |
| Example 11 | 17.3 | 0.098 | 81.1 |
| Example 12 | 18.5 | 0.105 | 77.9 |
| Example 13 | 15.2 | 0.112 | 73.1 |
| Example 14 | 17.2 | 0.089 | 85.9 |
| Example 15 | 21.1 | 0.135 | 70.8 |
| Example 16 | 20.8 | 0.125 | 77.9 |
| Example 17 | 16.9 | 0.106 | 79.5 |

As apparent from Tables 2 and 3, the bonded magnets according to Examples 4–17, which contain magnet materials obtained from the rapid-quenched alloy ribbons having a small standard deviation of the thickness, i.e., narrow variation in the thickness, are superior in the magnetic properties, in particular a maximum energy product.

EXAMPLES 18–27

Firstly, raw materials were mixed in respective predetermined proportions and melted by a high frequency wave in the argon gas atmosphere to obtain ten kinds of ingots. Subsequently, these ingots were melted by a high frequency wave induction heating in argon gas the atmosphere, followed by spraying the melted metals from a slit nozzle having a thickness of 0.5 mm onto a metal roller with a diameter of 300 mm which was being rotated at a rotating speed of 35 m/s, respectively, ten kinds of to produce ten kinds of rapid-quenched alloy ribbons. These alloy ribbons were then heat-treated in the argon gas atmosphere at 750° C. for 15 minutes.

Subsequently, the respective alloy ribbons were pulverized in a ball mill to produce alloy powders having an average particle size from 30 to 60 $\mu$m. These alloy powders were heat-treated (i.e., nitriding treatment) in the atmosphere at 1 atom and 440° C. for 80 hours to produce ten kinds of permanent magnet materials shown in Table 4. The phases in these alloy ribbons were observed by a powder X ray diffraction using $CuK_\alpha$ ray. As a result, all diffraction peaks except the diffraction peak of a minute α-Fe phase on the diffraction pattern were identified to a $TbCu_7$ type crystal structure. The ratio of the lattice constant c to the lattice constant a (c/a) was found to be from 0.856 to 0.868.

About the respective permanent magnet materials, photos of the metal texture thereof were taken with a transmission electron microscope. From the photos, the average value (t) of the crystal grain sizes of the $TbCu_7$ phase and the standard deviation (σ) thereof were calculated. The obtained result are shown in Table 5 below.

After that, two percentages by weight of an epoxy resin were added into the permanent magnet materials and mixed followed by being compression-molded at a pressure of 1000 MPa and cure-treated at 150° C. for 2.5 hours to manufacture ten kinds of bonded magnets.

The magnetic properties of the obtained bonded magnets were examined. The resultants are also shown in Table 5.

COMPARATIVE EXAMPLE 2

Firstly, Sm, Nd, Zr, B, Co, Ni and Fe having high purity were mixed in a predetermined proportion and melted by a high frequency wave in the argon gas atmosphere to obtain an ingot.

Subsequently, the ingot was melted by a high frequency induction wave heating in the argon gas atmosphere, followed by spraying the melted metal from a slit nozzle having a thickness of 1 mm onto a metal roller which was being rotated at a rotating speed of 25 m/s to produce a rapid-quenched alloy ribbon. The alloy ribbon was subjected to heat-treatment in the argon gas atmosphere, pulverizing, and heat-treatment in nitrogen gas in the same manner as in Examples 18–27 to produce a permanent magnet material having the composition as shown in Table 4. The magnet material was used to manufacture a bonded magnet in the same manner as in Examples 18–27.

Table 5 also shows the average value (t) of the crystal grain size of the $TbCu_7$ phase of the obtained magnet material, the standard deviation (σ) thereof, and magnetic properties of the bonded magnet.

COMPARATIVE EXAMPLE 3

Firstly, Sm, Nd, Zr, B, Co, Ni and Fe having high purity were mixed in a predetermined proportion and melted by a high frequency wave in the argon gas atmosphere to obtain an ingot.

Subsequently, the ingot was melted by a high frequency induction heating in the argon gas atmosphere, followed by spraying the melted metal from a slit nozzle having a thickness of 0.5 mm onto a metal roller which was being rotated at a rotating speed of 70 m/s to produce a rapid-quenched alloy ribbon. The alloy ribbon was subjected to heat-treatment in the argon gas atmosphere, pulverizing, and heat-treatment in nitrogen gas in the same manner as in Examples 18–27 to produce a permanent magnet material having the composition shown in Table 4. The magnet material was used to prepare a bonded magnet in the same manner as in Examples 18–27.

Table 5 also shows the average value (t) of the crystal grain size of the $TbCu_7$ phase of the obtained magnet material, the standard deviation (σ) thereof, and magnetic properties of the bonded magnet.

TABLE 4

| | Composition of permanent magnet materials (bal.: balance) |
|---|---|
| Example 18 | $Sm_{6.4}Nd_{0.3}Zr_{2.2}Co_{3.7}Ni_{0.2}B_{1.9}N_{14.5}$ Fe bal. |
| Example 19 | $Sm_{6.4}Pr_{0.3}Zr_{2.2}Co_{3.8}B_{1.8}C_{0.2}N_{14.8}$ Fe bal. |
| Example 20 | $Sm_{6.5}Ce_{0.3}Zr_{1.9}Hf_{0.2}Co_{3.9}Ti_{1.0}B_{2.2}N_{15.1}$ Fe bal. |
| Example 21 | $Sm_{6.4}Nd_{0.2}Gd_{0.1}Zr_{2.1}Co_{3.0}Si_{1.3}B_{1.4}N_{15.0}$ Fe bal. |
| Example 22 | $Sm_{6.5}Zr_{2.1}Nb_{0.2}Co_{4.2}Al_{0.4}B_{2.5}P_{0.2}N_{14.8}$ Fe bal. |
| Example 23 | $Sm_{6.7}Nd_{0.3}Zr_{1.7}Co_{4.6}Mn_{0.2}W_{0.2}B_{2.0}N_{13.9}$ Fe bal. |
| Example 24 | $Sm_{6.8}Er_{0.2}Zr_{1.7}Co_{9.5}Ga_{0.1}B_{2.2}C_{0.2}N_{14.3}$ Fe bal. |
| Example 25 | $Sm_{6.7}Zr_{2.1}Ta_{0.1}Co_{4.0}Cr_{1.1}B_{2.7}N_{15.1}$ Fe bal. |
| Example 26 | $Sm_{7.1}Ce_{0.2}Zr_{2.4}Sc_{0.1}Co_{4.5}V_{1.3}C_{1.5}N_{12.6}$ Fe bal. |
| Example 27 | $Sm_{6.8}Nd_{0.3}Zr_{1.9}Co_{5.0}Sn_{0.1}P_{0.1}C_{1.3}N_{13.4}$ Fe bal. |
| Comparative Example 2 | $Sm_{6.4}Nd_{0.3}Zr_{2.2}Co_{3.7}Ni_{0.2}B_{1.9}NB_{14.0}$ Fe bal. |
| Comparative Example 3 | $Sm_{6.5}Nd_{0.3}Zr_{2.2}Co_{3.8}Ni_{0.2}B_{2.0}N_{13.5}$ Fe bal. |

TABLE 5

| | Average crystal gram size t (nm) | Standard deviation of the crystal gram size σ(nm) | σ/t | Coercive force (kA/m) | Residual magnetization flux density (T) | Maximum energy product ($kJ/m^3$) |
|---|---|---|---|---|---|---|
| Example 18 | 18 | 5.2 | 0.29 | 625 | 0.79 | 83 |
| Example 19 | 15 | 5.5 | 0.37 | 633 | 0.76 | 79 |
| Example 20 | 14 | 4.5 | 0.32 | 650 | 0.72 | 80 |
| Example 21 | 18 | 7.5 | 0.42 | 630 | 0.77 | 79 |
| Example 22 | 15 | 3.9 | 0.26 | 622 | 0.75 | 84 |
| Example 23 | 13 | 7.9 | 0.61 | 655 | 0.70 | 73 |
| Example 24 | 17 | 6.8 | 0.40 | 669 | 0.68 | 75 |
| Example 25 | 16 | 5.6 | 0.35 | 610 | 0.78 | 77 |
| Example 26 | 14 | 7.5 | 0.54 | 638 | 0.69 | 72 |
| Example 27 | 17 | 4.7 | 0.28 | 621 | 0.71 | 73 |
| Comparative Example 2 | 25 | 19.3 | 0.77 | 556 | 0.65 | 62 |
| Comparative Example 3 | 12 | 10.5 | 0.88 | 621 | 0.62 | 60 |

As apparent from Tables 4 and 5, the bonded magnets according to Examples 18–27, which contain magnet materials having a variation in crystal grain sizes of the $TbCu_7$ phase, i.e., σ/t of 0.7 or less, are superior to the bonded magnets according to Comparative Examples 2 and 3 in magnetic properties, in particular a maximum energy product.

The bonded magnets of Examples 18–22, 24, 25 and 27, which contain a value σ/t of 0.5 or less, have more excellent magnetic properties. The bonded magnets of Examples 18, 22 and 27, which contain a value σ/t of 0.3 or less, have further more excellent magnetic properties.

As described above, the invention can provide a permanent magnet material having a principal phase of a $TbCu_7$ type crystal structure and improved magnetic properties.

The invention can also provide a bonded magnet which contains the permanent magnet material and a binder, which has stable, high magnetic properties, and which is useful for a driving source for small electric appliances, such as a speaker, a motor, and a measuring tool.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A permanent magnet material which is represented by the general formula:

$$R1_xR2_yB_zN_uM_{100-x-y-z-u}$$

wherein R1 is at least one element selected from the group consisting of rare earth elements and Y, R2 is at least one element selected from the group consisting of Zr, Hf and Sc, M is at least one element selected from Fe and Co, x, y, z and u are atomic percents individually defined as $x \geqq 2$, $y \geqq 0.01$, $4 \leqq x+y \leqq 20$, $0 \leqq z \leqq 10$, and $0<u \leqq 20$, said permanent magnet material having a principal phase of a $TbCu_7$ crystal structure, and said permanent magnet material is made from a rapid-quenched alloy ribbon which is prepared using a melt spun process, satisfying the conditions of $5 \leqq t \leqq 50$ and $\sigma \leqq 0.20t$, wherein t(μm) is the average thickness of said alloy ribbon and σ(μm) is the standard deviation of thickness in said alloy ribbon.

2. The permanent magnet material according to claim 1, wherein the range of the standard deviation σ of the thickness in said alloy ribbon is $\sigma \leqq 0.15t$.

3. The permanent magnet material according to claim 1, wherein the range of the standard deviation σ of the thickness in said alloy ribbon is $\sigma \leqq 0.10t$.

4. The permanent magnet material according to claim 1, wherein an amount of 50 or less atomic percentages of N in the general formula are replaced by at least one element selected from the group consisting of H, C and P.

5. The permanent magnet material according to claim 1, wherein the ratio (c/a) of the lattice constants a and c in the principal phase is 0.847 or more.

6. The permanent magnet material according to claim 1, wherein an amount 50 or more atomic percentages of R1 in the general formula are occupied by Sm.

7. The permanent magnet material according to claim 1, wherein z in the general formula is $0.01 \leqq z \leqq 4$.

8. The permanent magnet material according to claim 1, wherein z in the general formula is $0.01 \leqq z \leqq 2$.

9. The permanent magnet material according to claim 1, wherein M in the general formula is partly replaced by a T in an amount of at most 20 atomic percent based on the total amount of M, and the T is at least one element selected from the group consisting of Ti, V, C, Mo, W, Mn, Ga, Al, Sn, Ta, Nb, Si and Ni.

10. A bonded magnet, comprising a permanent magnet material according to claim 1 and a binder.

11. The bonded magnet according to claim 10, wherein the binder is an epoxy resin or a nylon resin.

12. A permanent magnet material which is represented by the general formula:

$$R1_xR2_yB_zN_uM_{100-x-y-z-u}$$

wherein R1 is at least one element selected from the group consisting of rare earth elements and Y, R2 is at least one element selected from the group consisting of Zr, Hf and Sc, M is at least one element selected from Fe and Co, x, y, z and u are atomic percents individually defined as $x \geqq 2$, $y \geqq 0.01$, $4 \leqq x+y \leqq 20$, $0 \leqq z \leqq 10$, and $0 < u \leqq 20$, said permanent magnet material having a principal phase of a $TbCu_7$ crystal structure, and satisfying the relation of $t \leqq 60$ and $\sigma/t \leqq 0.7$, wherein t(nm) is the average crystal grain size of the principal phase and σ(nm) is the standard deviation of the crystal grain size.

13. The permanent magnet material according to claim 12, wherein the ratio σ/t is 0.5 or less.

14. The permanent magnet material according to claim 12, wherein the ratio σ/t is 0.3 or less.

15. The permanent magnet material according to claim 12, wherein an amount of 50 or less atomic percentages of N in the general formula are replaced by at least one element selected from the group consisting of H, C and P.

16. The permanent magnet material according to claim 12, wherein the ratio (c/a) of the lattice constants a and c in the principal phase is 0.847 or more.

17. The permanent magnet material according to claim 12, wherein an amount of 50 or more atomic percentages of R1 in the general formula are occupied by Sm.

18. The permanent magnet material according to claim 12, wherein z in the general formula is $0.01 \leqq z \leqq 4$.

19. The permanent magnet material according to claim 1, wherein z in the general formula is $1 \leqq z \leqq 3$.

20. The permanent magnet material according to claim 12, wherein M in the general formula is partly replaced by a T in an amount of at most 20 atomic percent based on the total amount of M, wherein T is at least one element selected from the group consisting of Ti, V, C, Mo, W, Mn, Ga, Al, Sn, Ta, Nb, Si and Ni.

21. A bonded magnet, comprising a permanent magnet material according to claim 12, and a binder.

22. The bonded magnet according to claim 21, wherein the binder is an epoxy resin or a nylon resin.

* * * * *